US005490676A

United States Patent [19]

Rake et al.

[11] Patent Number: 5,490,676

[45] Date of Patent: Feb. 13, 1996

[54] PLAYING CARDS WITH GRIPPING SURFACE

[76] Inventors: Lance G. Rake, 917 Illinois St., Lawrence, Kans. 66044; Kermit T. Krantz, 12310 Granada, Leawood, Kans. 66209

[21] Appl. No.: 510,193

[22] Filed: Aug. 2, 1995

[51] Int. Cl.[6] ..... A63F 1/02

[52] U.S. Cl. ..... 273/294; 273/293; D21/42; D21/45

[58] Field of Search ..... 273/293, 294; D21/42–45

[56] References Cited

U.S. PATENT DOCUMENTS

D. 38,868 11/1907 Thomas ..... 273/294

1,704,017 9/1928 Reed ..... 273/294

*Primary Examiner*—Benjamin H. Layno

*Attorney, Agent, or Firm*—Hovey, Williams, Timmons & Collins

[57] ABSTRACT

Playing cards that are ergonomically designed to fit a person's hands to facilitate handling, shuffling and dealing are disclosed. The end edges of the playing cards are formed with undulating curves. The undulating curves each present an inwardly curved portion specifically designed to receive the player's thumb and an adjacent outwardly curved portion specifically designed to receive the player's opposing fingers.

9 Claims, 1 Drawing Sheet

PLAYING CARDS WITH GRIPPING SURFACE

BACKGROUND OF THE INVENTION

1. Field of the Invention

The present invention relates to playing cards, and more particularly to playing cards that are ergonomically designed to fit a person's hands to facilitate handling, shuffling and dealing.

2. Description of the Prior Art

Conventional playing cards are rectangular in shape with straight edges and thus are not designed to fit a persons's hand. Accordingly, they are difficult to handle, shuffle and deal and can cause hand strain and discomfort during prolonged card playing.

Playing cards with curved edges are known in the art. However, these prior art playing cards are not designed for improving a player's grip for shuffling and dealing, but rather are formed with curves merely to eliminate marring on the cards' edges during shuffling.

Accordingly, there is a need for improved playing cards that overcome the limitations of prior art playing cards. More particularly, there is a need for playing cards that are ergonomically designed to fit a person's hands to facilitate comfortable and easy handling, shuffling and dealing.

OBJECTS AND SUMMARY OF THE INVENTION

The present invention overcomes the problems outlined above and provides an improved design of playing cards. More particularly, the invention provides playing cards that are ergonomically designed to fit a person's hands to facilitate comfortable and easy handling, shuffling and dealing.

The preferred playing card broadly includes a front face, a rear face, a pair of elongated, opposed side edges and a pair of elongated, opposed end edges, extending generally perpendicularly to the side edges. Advantageously, each of the end edges is curved to provide a gripping surface on the card.

In preferred forms, the end edges are formed with undulating, serpentine, s-shaped, or concavo-convex curves. The undulating curves each present an inwardly curved portion specifically designed to receive the player's thumb and an adjacent outwardly curved portion specifically designed to receive the player's fingers. The inwardly curved portion presents a concave section and the outwardly curved portion presents a convex section.

The undulating curves on the end edges are identical but are shifted 180 degrees relative to one another. Thus, the concave section on one end edge is diametrically opposed or diagonal from the concave section on the opposite end edge. Similarly, the convex section on one end edge is diametrically opposed or diagonal from the convex section on the opposite end edge. This configuration allows the card to be held so that the player's thumb is adjacent one side edge of the card and the player's opposing fingers are adjacent the opposite side edge.

By constructing a playing card as described above, numerous advantages are realized. For example, by providing undulating curved regions on each of the card's end edges, card players can more easily grip, shuffle and deal the playing cards.

Additionally, by providing end edges with an inwardly curved portion designed to fit the player's thumb and an adjacent outwardly curved portion designed to fit the player's fingers, the player can effectively hold, shuffle and deal the playing cards without exerting much force on the cards. Accordingly, the playing cards require less strength to use and therefore reduce or eliminate hand strain and discomfort.

Finally, by shifting the undulating curves on the end edges 180 degrees relative to one another, the player's thumb and fingers are placed in an opposing relationship and a more natural and controlled hand grip is provided.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENTS

Figure 1:
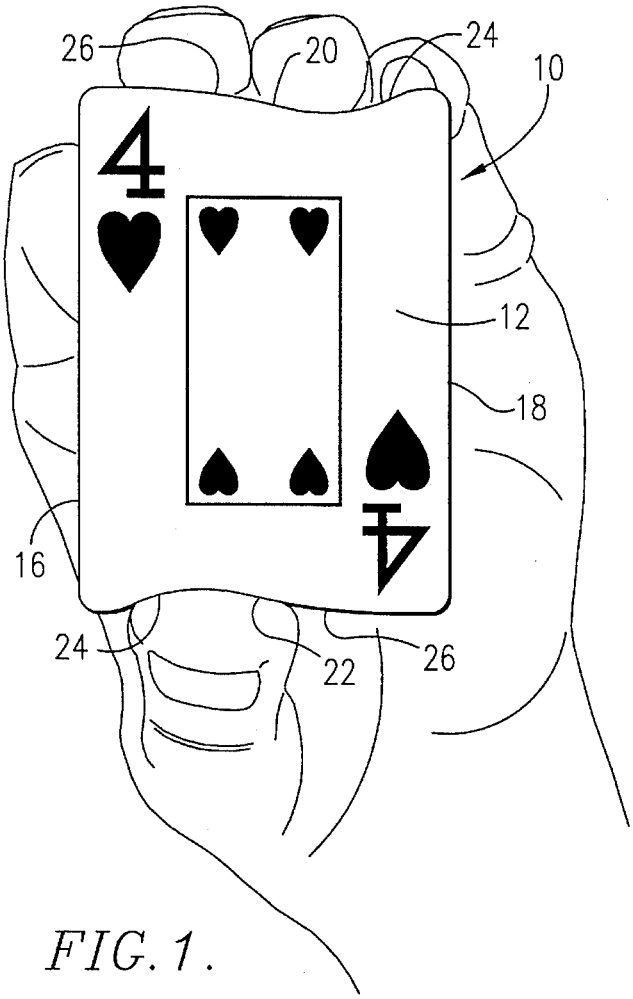
FIG. 1 is a front view of a playing card constructed in accordance with a first embodiment of the invention.

Turning now to FIG. 1, a playing card 10 constructed in accordance with a preferred embodiment of the invention is illustrated. Each playing card 10 broadly includes a front face 12, a rear face 14 (see FIG. 2), an elongated left side edge 16, an elongated right side edge 18, an elongated upper end edge 20, and an elongated lower end edge 22. Although playing cards are typically designed so that they can be handled and read regardless of how they are held, the left, right, upper and lower directions are used herein to facilitate the description of a preferred embodiment of the invention.

In more detail, the playing card 10 is preferably formed of laminated paperboard material, but may also be formed of thin plastic or other suitable material. The preferred playing card 10 presents a width of approximately 2.5 inches and a length of approximately 3.5 inches, but can be sized to accommodate the hands of different sized people.

The front face 12 of the card 10 has unique indicia printed thereon for identifying the suit and number of the card. The rear face 14 preferably includes a design printed thereon for decorating the card.

The left and right side edges 16 and 18 are each approximately 3–4 inches long and are generally straight. Each side edge 16 and 18 curves gently inwardly at its ends to form rounded corners at the intersection with the upper and lower end edges 20 and 22. The rounded corners resist snagging and marring of the playing cards.

Figure 2:
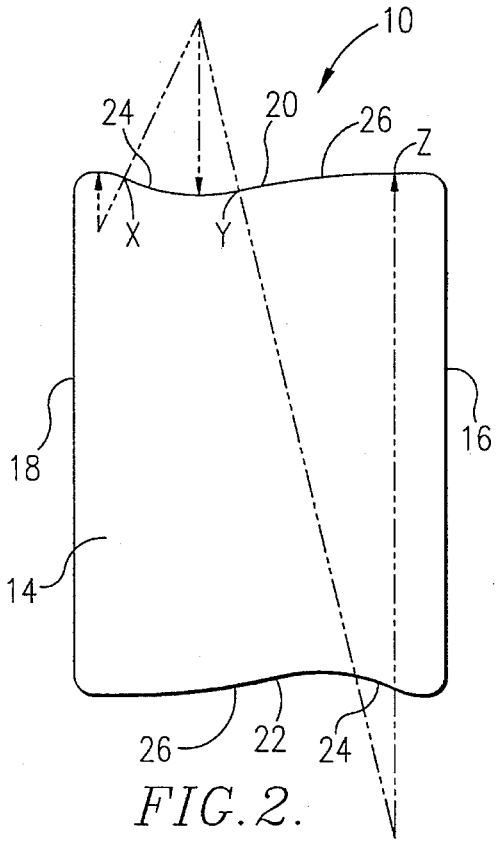
FIG. 2 is a rear view of the playing card illustrated in FIG. 1.

As best illustrated in FIG. 2, the upper and lower end edges 20 and 22 are each approximately 2–3 inches long and are curved for providing a gripping surface for players to handle, shuffle and deal the cards. Each curved surface is preferably an undulating, serpentine, s-shaped, or concavo-convex curve having an inwardly curved portion 24 specifically designed to receive a player's thumb and an adjacent outwardly curved portion 26 specifically designed to receive the player's opposing fingers. The inwardly curved portion presents a concave section and the outwardly curved portion presents a convex section.

The undulating curves on the upper and lower end edges 20 and 22 are identical but are shifted 180 degrees relative to one another. Thus, the concave section on one end edge is diametrically opposed or diagonal from the concave section on the opposite end edge. Similarly, the convex section on one end edge is diametrically opposed or diagonal from the convex section on the opposite end edge. This configuration allows the card to be held so that the player's thumb is adjacent one side edge of the card and the player's opposing fingers are adjacent the opposite side edge, thus providing a more natural and controlled hand grip on the card.

As described above, the inwardly curved portions 24 present a relatively steep inward slope for providing a concave section in the ends of the card for securely engaging the player's thumb. The inwardly curved portion 24 for the upper end 20 of the card 10 is preferably formed with a radius of curvature of approximately 1–1.25 inches measured from an axis approximately 1 inch from the uppermost end of the card 10 and 0.75–1 inch from the right side 18 of the card. Similarly, the inwardly curved portion 24 for the lower end 22 of the playing card 10 has the same radius of curvature measured from an axis approximately 1 inch from the lowermost end of the card 10 and 0.75–1 inch from the left side 16 of the card 10.

The inwardly curved portion 24 for the upper end 20 of the card 10 has an arc extending the length between the points labeled X–Y in FIG. 2. The angle formed by the axis of the inwardly curved portion 24 and the points X–Y is approximately 40 degrees. The inwardly curved portion 24 for the lower end 22 has similar end points and arc length.

The outwardly curved portions 26 are adjacent the inwardly curved portions 24 and are designed for engaging the player's fingers. Each outwardly curved portion 26 presents a relatively gradual slope that intersects the inwardly curve portions 24 at point Y in FIG. 2.

The outwardly curved portion 26 for the upper end 20 of the card 10 is preferably formed with a radius of curvature of approximately 4.25–4.5 inches measured from an axis 4.25–4.5 inches from the uppermost end of the card and 2–2.25 inches from the right side 18 of the playing card 10. Similarly, the outwardly curved portion 26 for the lower end 22 of the playing card 10 has the same radius of curvature measured from an axis 4.25–4.5 inches from the lowermost end of the card 10 and 2–2.25 inches from the left side 16 of the card 10.

The outwardly curved portion 26 for the upper end 20 of the card 10 has an arc extending the length between the points Y–Z in FIG. 2. The angle formed by the axis of the outwardly curved portion 26 and the points Y–Z is approximately 10–15 degrees. The outwardly curved portion 26 for the lower end 22 has similar end points and arc length.

The playing cards 10 of the present invention provide a distinct advance in the design of playing cards. For example, the undulating curved regions on each of the cards' upper and lower end edges 20 and 22 allow card players to more easily grip, shuffle and deal the playing cards. Additionally, since the inwardly curved portions 24 securely engage a player's thumb and the outwardly curved portions 26 engage the player's opposing fingers, the player can effectively hold, shuffle and deal the playing cards 10 without exerting much force on the cards. Accordingly, the playing card 10 requires less strength to use and therefore reduces or eliminates hand strain and discomfort.

Figure 3:
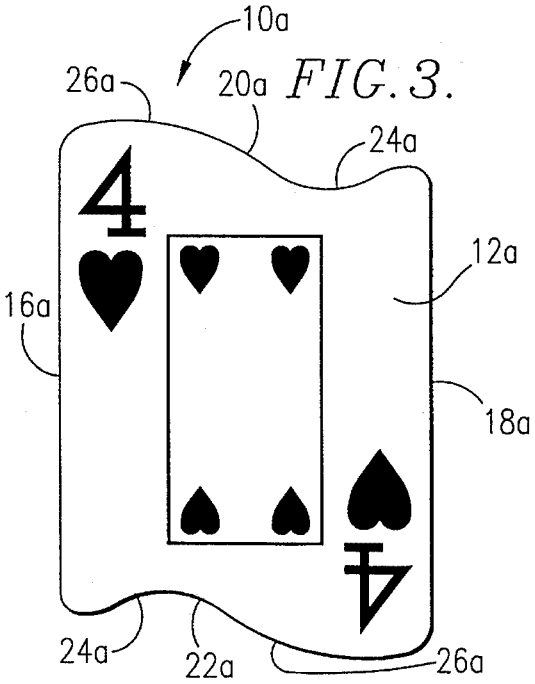
FIG. 3 is a front view of a playing card constructed in accordance with a second embodiment of the invention.

The playing card 10 may also be constructed in accordance with several alternate embodiments. As illustrated in FIG. 3, the card's right side edge 18A may be shifted downward relative to the left side edge 16*a* so that the inwardly curved portions 24*a* of card 10*a* are closer to the center of the card. This design allows a player to handle the card 10*a* without stretching his or her hands as far as when the inwardly curved portions 24a are further from the center of the cards.

Figure 4:
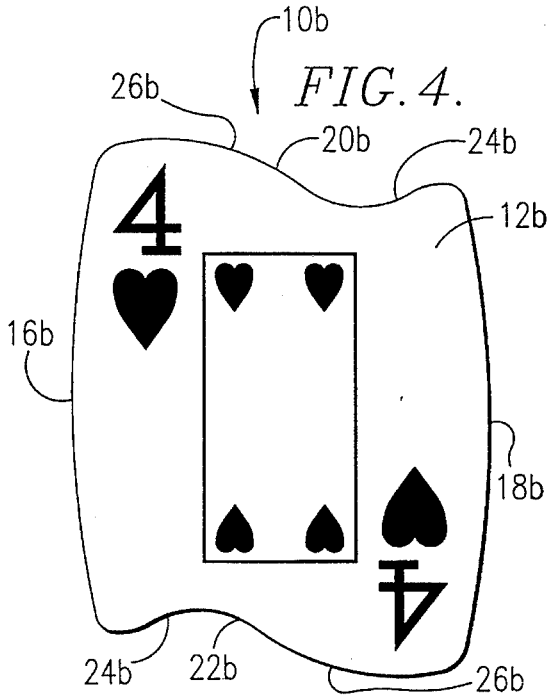
FIG. 4 is a front view of a playing card constructed in accordance with a third embodiment of the invention.

Additionally, as illustrated in FIG. 4, the playing card 10*b* may include left and right side edges 16*b* and 18*b* that curve outwardly to improve handling, shuffling and dealing.

Although the invention has been described with reference to the preferred embodiments illustrated in the attached drawing figures, it is noted that equivalents may be employed and substitutions made herein without departing from the scope of the invention as recited in the claims. For example, although preferred dimensions of the cards have been disclosed to facilitate the description of a preferred embodiment of the invention, those skilled in the art will appreciate that the dimension of the playing cards can be adapted to fit different sized players.

Having thus described the preferred embodiment of the invention, what is claimed as new and desired to be protected by Letters Patent includes the following:

1. A playing card comprising:

a front face;

a rear face;

a pair of elongated, opposed side edges; and a pair of elongated, opposed end edges extending between said side edges, each of said end edges presenting a concavo-convex shaped curved surface for facilitating gripping of the playing card.

2. The playing card as set forth in claim 1, each of said end edges including a first inwardly curved portion for receiving a card player's thumb and a second outwardly curved portion for receiving the card player's opposing fingers.

3. The playing card as set forth in claim 2, said inwardly curved portions having a radius of curvature of approximately 1–1.25 inches.

4. The playing card as set forth in claim 2, each of said outwardly curved portions having a radius of curvature of approximately 4.25–4.5 inches.

5. The playing card as set forth in claim 1, wherein said playing card is formed of laminated paperboard material.

6. A playing card comprising:

a front face;

a rear face;

a pair of elongated, opposed left and right side edges; and a pair of elongated, opposed upper and lower end edges extending between said left and right side edges, each of said upper and lower end edges presenting a curved surface, each of said curved surfaces having an inwardly curved portion for engaging a player's thumb, said inwardly curved portion presenting a first radius of curvature, and an outwardly curved portion for engaging a player's fingers, said outwardly curved portion presenting a second radius of curvature, said first radius of curvature being less than said second radius of curvature.

7. The playing card as set forth in claim 6, each of said inwardly curved portions having a radius of curvature of approximately 1–1.25 inches.

8. The playing card as set forth in claim 7, each of said outwardly curved portions having a radius of curvature of approximately 4.25–4.5 inches.

9. The playing card as set forth in claim 6, wherein said playing card is formed of laminated paperboard material.

* * * * *